United States Patent [19]

Neubert et al.

[11] Patent Number: 4,836,130

[45] Date of Patent: Jun. 6, 1989

[54] DEVICE FOR COATING METALLIC INTERNAL SURFACES

[76] Inventors: Eberhard Neubert, Kraehenweg 7, 9560 Zwickau; Hans-Michael Wardenga, Karl-Keil-Str. Wohnheim I, 9500 Zwickau; Gottlieb Polzer, Seminarstr. 14, 9550 Zwickau; Juergen Lange, Gneisenaustr. 16, 9620 Werdau; Klaus Schrader, Str. d. Jungen Pioniere 3, 9500 Zwickau; Frank Junker, Rostenstr. 16, 8122 Radebeul; Norbert Dittmann, Augustusweg 103 e, 8122 Radebeul; Ullrich Spevacek, Hermann-Matern-Str. 3 c, 8270 Coswig; Hans-Juergen Tappert, Heinrich-Rau-Str. 4 c, 8270 Coswig, all of German Democratic Rep.

[21] Appl. No.: 98,031

[22] Filed: Aug. 28, 1987

[30] Foreign Application Priority Data

Aug. 29, 1986 [DD] German Democratic Rep. ..... 293967.6

[51] Int. Cl.[4] ..... B05C 11/00

[52] U.S. Cl. ..... 118/76; 427/11

[58] Field of Search ..... 118/76, 77; 427/11; 184/99

[56] References Cited

FOREIGN PATENT DOCUMENTS 215095 10/1984 German Democratic Rep. ... 118/76

0234035 3/1986 German Democratic Rep. .

*Primary Examiner*—Shrive Beck

*Assistant Examiner*—Alain Bashore

*Attorney, Agent, or Firm*—Michael J. Striker

[57] ABSTRACT

A device for coating metallic internal surfaces of cylindrical objects, particularly cylindrical sliding sleeves, by rubbing materials onto said surfaces includes one or a plurality of rubbing heads each including rubbing pins positioned in said rubbing head at an angle relative to each other. Each rubbing head is displaceable along an axis thereof. A rotationally-fixed housing carries a rotatable bevel gear. The rubbing head is rotational and provided with pinions meshed with said bevel gear.

5 Claims, 2 Drawing Sheets

DEVICE FOR COATING METALLIC INTERNAL SURFACES

BACKGROUND OF THE INVENTION

The present invention relates to a device for coating internal surfaces of metallic objects, particularly cylindrical sliding sleeves.

A device of the type under consideration includes a plurality of rotary rubbing pins which apply a coating material to an internal face of a cylindrical article. One of such devices has been disclosed in DD-PS No. 215,095. This conventional device includes two diametrically opposing rubbing pins positioned on two respective shafts which are driven by a drive connected with a motor through a transmission device and, at the same time, is loaded from the pressure cylinder with a constant pressure which is continually adjustable by the pressure cylinder, during the rubbing process.

The disadvantage of this otherwise satisfactory device resides in that it is not suitable for coating cylinder block.

A device for coating internal surfaces disclosed in patent application DD-PS No. 234,035 also includes two rotating rubbing pins positioned in the rubbing head at an acute angle relative to each other and coupled with a drive unit and a pressure unit through a transmission member. In order to coat internal surfaces of cylindrical objects, for example cylindrical sliding sleeves, it is necessary to impart a rotational motion to the objects being coated.

The disadvantage of the aforedescribed device is that the coating of the surfaces is not possible with the stationary motor block and therefore a simultaneous treatment of many bores in one motor block cannot be realized. A further disadvantage of this known device resides in that this device is applicable only to a certain type of the machine, which makes the device rather expensive.

SUMMARY OF THE INVENTION

It is an object of the present invention to provide an improved device for coating internal surfaces of metallic objects, such as cylindrical sliding sleeves.

It is another object of the invention to provide a device for coating internal metallic surfaces, which is less expensive to manufacture than conventional machines of the foregoing type.

Yet another object of the invention is to provide a device for coating metallic internal surfaces of cylindrical articles, which would enable the coating of a plurality of cylindrical bores simultaneously, in a non-movable cylinder block.

Still another object of the invention is to provide a coating device which would improve the insertion of the structural components into the objects being treated, reduce a friction force applied, increase reliability and service life of the rubbing pins, reduce friction corrosion and improve endurance ratio.

These and other objects of the invention are attained by a device for coating metallic internal surfaces of cylindrical objects, particularly cylindrical sliding sleeves by rubbing materials onto said surfaces, the device comprising at least one rubbing head including rubbing pins positioned in said rubbing head at an angle relative to each other, said rubbing head being displaceable along an axis thereof; a rotationally-fixed housing carrying a rotatable bevel gear, said rubbing head being rotational and provided with pinions meshed with said bevel gear.

The rubbing head may be positioned below said housing, said housing having a rotatable spindle connected to said rubbing head.

Each rubbing pin may correspond to a respective pinion.

The device may include a plurality of said rubbing heads each provided at a periphery thereof with a spur gear, which is in mesh with the spur gear of a neighboring rubbing head.

The neighboring rubbing heads have axes which may be spaced from each other by a distance Z corresponding to a diameter of the spur gear.

The advantage of the device according to this invention is that the rotational movement of the rubbing head induced by the drive spindle is superposed with the axial movement, i.e. lifting and lowering of the coating head, which axial movement is generated by the feeding device, and that the rubbing pins are rotated relative to the rubbing head due to the rotational motion of the rubbing head.

The device of the invention makes possible the coating of one or a plurality of bores of a non-movable cylindrical article simultaneously.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
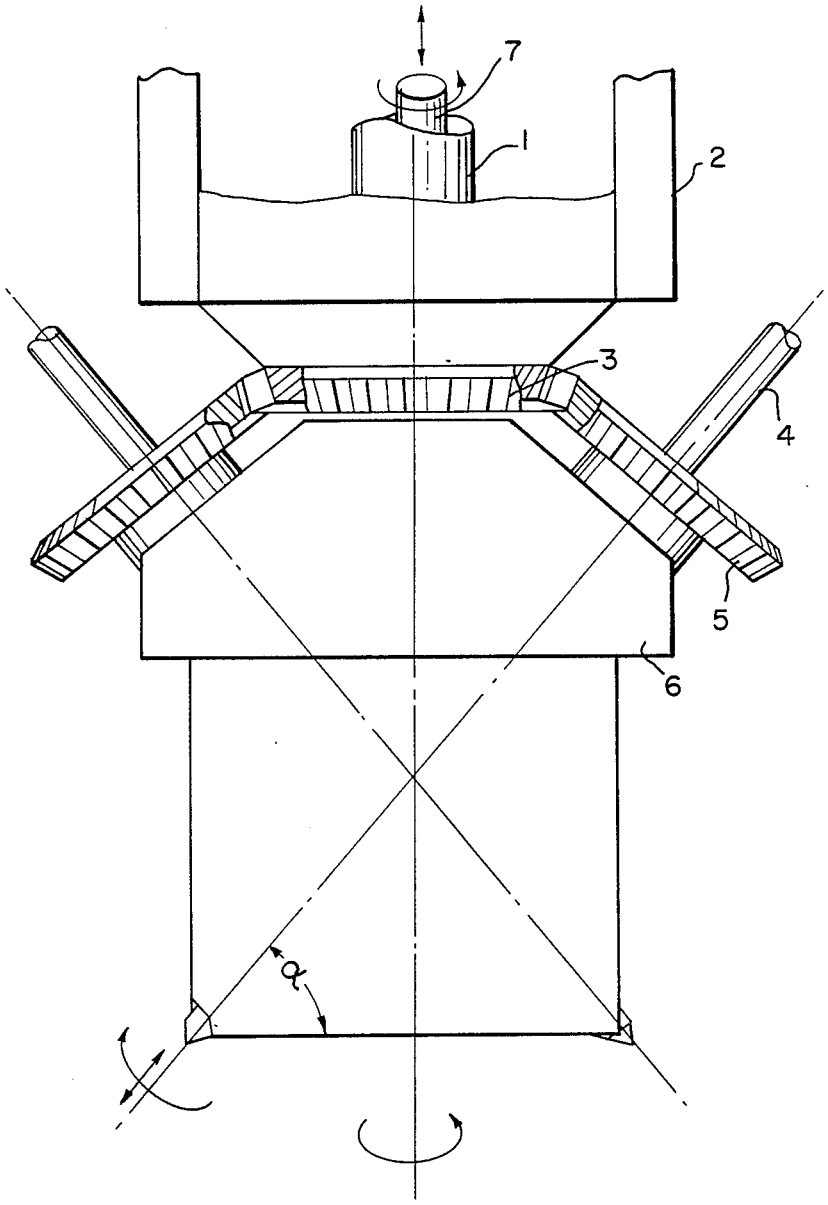
FIG. 1 is a schematic view of the coating head.

Referring now to the drawings in detail, and firstly to FIG. 1 which schematically illustrates a front view of the device with a single coating head, this coating head comprises a bevel gear 3 rigidly mounted on a rotation-fixed housing 2. A drive spindle 1 is supported in housing 2. The drive spindle 1 receives a driving piston rod 7 which acts on drive pins 4. A cylindrical rubbing head 6 is supported at the lower portion of housing 2 rotationally relative to that housing. Two rubbing pins 4, positioned at an angle relative to each other, are accommodated in the rubbing head 6. The rubbing pins 4 which are made of brass or other suitable material are dimensioned so that they extend outwardly from the rubbing head 6 at two sides thereof. A pinion 5 which is in mesh with the bevel gear 3 corresponds to each rubbing pin 4. These pinions are rotationally supported on the rubbing head 6. In the embodiment of FIG. 1 both rubbing pins 4 extend outwardly from the rubbing head 6 at the lower edge thereof.

Figure 2:
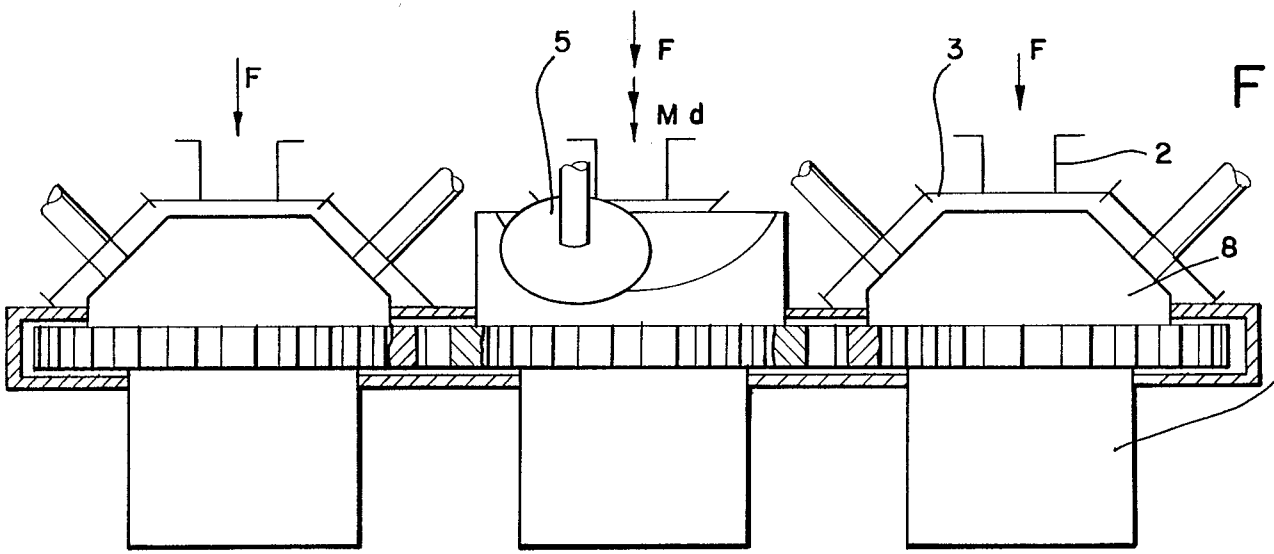
FIG. 2 is a schematic view of a multi-head coating device.
Figure 3:
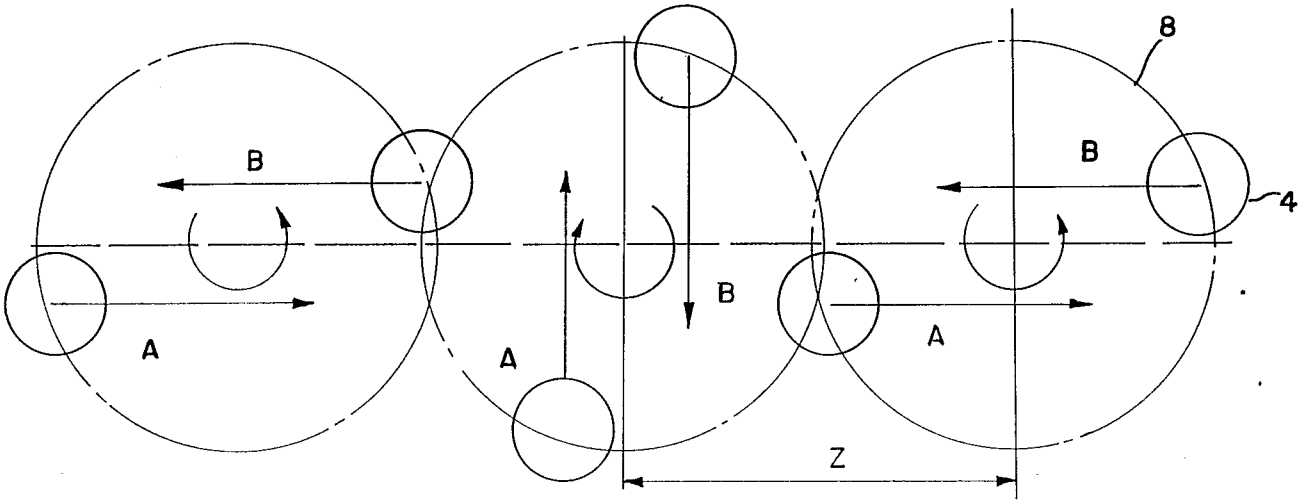
FIG. 3 is a schematic top plan view of the head coating device of FIG. 2.

With reference to FIGS. 2 and 3 it will be seen that the rubbing pins 4 can extend outwardly from the lower part of the peripheral surface of the rubbing head 6. This rubbing head is connected with the drive spindle 1.

The drive for the axial movement of the rubbing head 6, which movement is executed by a feeding unit of the machine is conventional and not shown herein.

FIGS. 2 and 3 show that a plurality, for example 3, coating heads can be connected to each other in one machine. For this purpose a spur gear 8 is provided on the rubbing head 6 of each coating head. The spur gears 8 of the neighboring coating heads are in mesh with one another. The neighboring rubbing heads 6 are mirror-inverted in their internal design and relative to the positions of the rubbing pins 4 they are offset by 90°. This is necessary to avoid contact of the pins of two neighboring coating heads as clearly shown in FIG. 3.

The axes of the coating heads in the multi-head machine of FIGS. 2 and 3 are spaced by distance Z from each other. The direction of rotation of each rubbing head 6 is shown by an arrow in FIG. 3. Arrows A and B in FIG. 3 show the length of rubbing pins 4 in the top plan view.

Only one torque Md is induced on the rubbing heads 6 by spindle 1 in the multi-head coating device.

The mode of operation of the device according to the invention is as follows:

The cylindrical sliding sleeve to be coated (not shown) or a cylinder block (also not shown) corresponds to each rubbing head 6. The rubbing head 6 is set in rotation relative to the rotation-fixed housing 2 by the drive spindle 1. The pinions 5 which are in mesh with the bevel gear 3 are rotated about this gear and in turn rotate the rubbing pins 4 so that the rubbing pins 4 execute a relative rotation motion to the rubbing head 6. At the same time, the piston rod 7 acts on the rubbing head 6 to displace the latter in the axial direction as shown by arrows in FIG. 1; this axial motion of the rubbing head is imparted to the rubbing pins 4 so that they abut against the internal surface of the workpiece to be coated.

With the multi-head coating device, the inducing of the rotation movement is carried out only by one drive spindle 1 whereby the rotational movement is imparted to the rubbing head 6 corresponding to that spindle and is translated to the neighboring rubbing heads via the spur gears 8.

It will be understood that each of the elements described above, or two or more together, may also find a useful application in other types of devices for coating metallic surfaces of cylindrical articles differing from the types described above.

While the invention has been illustrated and described as embodied in a device for coating metallic surfaces of cylindrical articles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for coating metallic internal surfaces of stationary cylindrical objects, particularly cylindrical sliding sleeves, by rubbing materials onto said surfaces, the device comprising at least one rubbing head having a head axis and including rubbing pins positioned in said rubbing head at an acute angle relative to each other and also relative to said head axis, each of said pins having a pin axis, said rubbing head being displaceable along said axis; means for displacing said rubbing head along said head axis; a rotationally-fixed housing carrying a bevel gear, said rubbing head being rotational and provided with pinions meshed with said bevel gear; and means for rotating said rubbing head about said head axis so that said pinions are rotated due to the meshing with said bevel gear and thereby rotate said rubbing pins so that each of said rubbing pins rotates about said head axis and about its pin axis and is displaced along said head axis.

2. The device as defined in claim 1, wherein said rubbing head is positioned below said housing, said housing having a rotatable spindle connected to said rubbing head and forming said means for rotating said rubbing head.

3. The device as defined in claim 1, wherein each rubbing pin corresponds to a respective pinion.

4. The device as defined in claim 1, including a plurality of said rubbing heads each provided at a periphery thereof with a spur gear, which is in mesh with the spur gear of a neighboring rubbing head.

5. The device as defined in claim 4, wherein neighboring rubbing heads are arranged near one another so that their head axes are spaced from each other by a distance Z.

* * * * *